US007931758B2

(12) United States Patent
Cao et al.

(10) Patent No.: US 7,931,758 B2
(45) Date of Patent: Apr. 26, 2011

(54) THERMAL MECHANICAL TREATMENT OF FERROUS ALLOYS, AND RELATED ALLOYS AND ARTICLES

(75) Inventors: Wei-Di Cao, Charlotte, NC (US); Erin T. McDevitt, Indian Trail, NC (US)

(73) Assignee: ATI Properties, Inc., Albany, OR (US)

( * ) Notice: Subject to any disclaimer, the term of this patent is extended or adjusted under 35 U.S.C. 154(b) by 435 days.

(21) Appl. No.: 12/180,743

(22) Filed: Jul. 28, 2008

(65) Prior Publication Data

US 2010/0018615 A1 Jan. 28, 2010

(51) Int. Cl.
*C21D 8/00* (2006.01)

(52) U.S. Cl. ..... 148/326; 148/327; 148/607; 148/608; 148/547

(58) Field of Classification Search ..... 148/607, 148/608, 547, 326, 327; 420/53, 47, 49
See application file for complete search history.

(56) References Cited

U.S. PATENT DOCUMENTS

| | | | |
|---|---|---|---|
| 3,347,663 | A | 10/1967 | Bieber |
| 3,408,178 | A | 10/1968 | Myers et al. |
| 3,556,776 | A | 1/1971 | Clarke, Jr. et al. |
| 3,658,513 | A | 4/1972 | Clarke, Jr. et al. |
| 5,000,912 | A | 3/1991 | Bendel et al. |
| 5,035,855 | A | 7/1991 | Utsunomiya et al. |
| 5,512,237 | A | 4/1996 | Stigenberg |
| 5,681,528 | A | 10/1997 | Martin et al. |
| 5,855,844 | A | 1/1999 | Martin |
| 5,876,521 | A | 3/1999 | Koo et al. |
| 5,888,449 | A | 3/1999 | Kennedy et al. |
| RE36,382 | E | 11/1999 | Hultin-Stigenberg |
| 5,976,282 | A | 11/1999 | Fukuda et al. |
| 6,793,744 | B1 | 9/2004 | Jung |
| 2004/0238079 | A1 | 12/2004 | Kimura et al. |
| 2005/0126662 | A1 | 6/2005 | Cao |
| 2006/0065327 | A1 | 3/2006 | Buck |

FOREIGN PATENT DOCUMENTS

| | | | |
|---|---|---|---|
| EP | 1288316 | A1 | 3/2003 |
| EP | 1689903 | B1 | 7/2008 |
| FR | 2086805 | A | 12/1971 |
| JP | 60-36649 | | 2/1985 |
| JP | 60-92457 | A | 5/1985 |

(Continued)

OTHER PUBLICATIONS

Afanas'ev, V.D. et al., "Increasing the Mechanical Properties of 07Kh16N6 Steel by Heat Treatment," Metal Science and Heat Treatment, Springer, New York, NY, vol. 33, Nos. 9/10, Sep. 1, 1991, pp. 735-737.

(Continued)

*Primary Examiner* — Deborah Yee
(74) *Attorney, Agent, or Firm* — K & L Gates LLP; Patrick J. Viccaro; John E. Grosselin, III

(57) ABSTRACT

A thermal mechanical treatment method includes hot working a precipitation hardening martensitic stainless steel, quenching the stainless steel, and aging the stainless steel. According to certain embodiments, the thermal mechanical treatment does not include solution heat treating the stainless steel prior to aging or cryogenically cooling the stainless steel. An article includes a precipitation hardening martensitic stainless steel having a process history that includes hot working the stainless steel, quenching the stainless steel, and aging the stainless steel. According to certain embodiments, the process history does not include solution heat treating the stainless steel prior to aging or cryogenically cooling the stainless steel.

32 Claims, 7 Drawing Sheets

FOREIGN PATENT DOCUMENTS

| | | | |
|---|---|---|---|
| JP | 2-111844 | A | 4/1990 |
| JP | 2-310339 | A | 12/1990 |
| JP | 2000-192196 | A | 7/2000 |
| JP | 2002-206147 | A | 7/2002 |
| JP | 9-170019 | A | 6/2008 |
| WO | WO 02/079534 | A1 | 10/2002 |

OTHER PUBLICATIONS

Klueh R.L. et al., "A potential new ferritic/martensitic steel for fusion applications," Journal of Nuclear Materials, Elsevier Science B.V., vol. 283-287, 2000, pp. 697-701.

Geng, W.T. et al., "Influence of alloying additions on grain boundary cohesion of transition metals: First-principles determination and its phenomenological extension," The American Physical Society, Physical Review B, vol. 63, 2001, pp. 165415-1-165415-9.

ATI Allvac, ATI 13-8 Supertough® Alloy, Technical Data Sheet, Jun. 30, 2008, pp. 1-5.

Written Opinion of the International Searching Authority for International Application No. PCT/US2009/037237, European Patent Office, mailed Jun. 15, 2009, 9 pages.

International Search Report for International Application No. PCT/US2009/037237, European Patent Office, mailed Jun. 15, 2009, 8 pages.

Cao, W.D. et al., "C250 Equivalent High Strength Stainless Steel—Allvac S240™ Development", Jun. 7-10, 2004 AeroMat 2004 presentation, Session 2: Landing Gear Materials, Jun. 10, 2004, Seattle, Washington, 1 page.

Weber, Hartwin R., "A New High Strength Stainless Maraging Spring Steel with Isotropic Shaping Capability", Advanced Engineering Materials 2001, 3, No. 9, pp. 698-701.

Martin, James W. and James M. Dahl, "High strength stainless alloy resists stress corrosion cracking", Advanced Materials & Processes, 3/98, pp. 37-39.

Papier, J.H., "Marval X 12: A Stainless Maraging Steel Used in Aerospace Applications," The Minerals, Metals & Materials Society, 1988, pp. 125-155.

Perry, D.C.,"Recent Developments in Precipitation Hardenable Stainless Steels", as presented at the Golden Gate Welding and Metals Conference, Nov. 8, 1972, pp. 1-9.

Potak, Ya. M., et al., "Structural diagram of low-carbon stainless steels applicable to metal that was cast and deposited during welding," (1972) Avtomaticheskaya Svarka 25(5), pp. 10-13. (Abstract only).

Carpenter Technical Datasheet—Custom 465® Stainless, printed from http://cartech.ides.com/datasheet.aspx?&I=101&E=55&FMT=PRINT on Oct. 24, 2008, 16 pages.

Technical Data Sheet: ATI S240® Alloy, ATI Allvac, Sep. 30, 2008, 4 pages.

Metal Suppliers Online, Properties of Stainless Steel 13-8 Plus Related Metals, printed from http://www.metalsuppliersonline.com/Research/Property/metals/1737.asp on Oct. 24, 2008, 3 pages.

Metal Suppliers Online, 15-5 Stainless Steel, printed from http://www.suppliersonline.com/propertypages/15-5.asp on Oct. 24, 2008, 4 pages.

Technical Data Sheet: ATI S240™ Alloy, ATI Allvac, Apr. 22, 2008, 4 pages.

Specification Sheet: 17-4PH (UNS S17400), Sandmeyer Steel Company, Jun. 2003, 2 pages.

Data Sheet for Alloy PH13-8MO, Brown-Pacific, Inc. 2001, printed from http://www.brownpacific.com/Product_Literature/ALLOY_PH13-8MO/alloy_ph13-8mo.html on Sep. 2, 2008, 2 pages.

Data Sheet for AMS 5659 (15-5PH), Corus Engineering Steels, Jun. 2003, 2 pages.

"Ultra-High-Strength Stainless Steel Resists Stress Corrosion Cracking," in article entitled "Innovations in Specialty Steels," Advanced Materials & Processes, Jan. 2004, pp. 26-35.

Guitterez, Anthony, "High-Strength Stainless Steels," Advanced Materials & Processes, Jun. 2006, 4 pages.

Technical Data Sheet—ATI 13-8Mo Alloy, ATI Allvac, Sep. 17, 2010, 4 pages.

AISI Type SI4800, Stainless/Heat-Resisting, Engineering Properties of Steel, 1982, 3 pages.

Product Data Sheet—15-5PH Stainless Steel, UNS S15500, AK Steel Corporation, Aug. 1, 2007, 2 pages.

Product Data Sheet—17-4PH Stainless Steel, UNS S17400, AK Steel Corporation, Aug. 1, 2007, 2 pages.

UNS S45000, Corus Engineering Steels, Aug. 2001, 2 pages.

Technical Data Sheet—Carpenter Custom 455® Stainless (S45500), CRS Holdings Inc:, a subsidiary of Carpenter Technology Corporation, Copyright 2011, Edition Date: Jun. 9, 2006, pp. 1-13.

Technical Data Sheet—Carpenter Custom 465® Stainless (S46500), CRS Holdings Inc., a subsidiary of Carpenter Technology Corporation, Copyright 2011, Edition Date: Jan. 8, 2008, pp. 1-16.

THERMAL MECHANICAL TREATMENT OF FERROUS ALLOYS, AND RELATED ALLOYS AND ARTICLES

BACKGROUND OF THE TECHNOLOGY

1. Field of the Technology

The present disclosure is directed to thermal mechanical treatment of high strength precipitation hardening martensitic stainless steels. In particular, a thermal mechanical treatment is disclosed that includes hot working and direct aging.

2. Description of the Background of the Technology

Significant efforts have been made to formulate certain stainless steel alloys, such as martensitic precipitation hardening (PH) stainless steel alloys, that exhibit superior properties for use in high performance articles. The potential for excellent strength-to-weight ratios, toughness, corrosion resistance, and stress corrosion cracking (SCC) resistance of articles formed from these alloys make them particularly well suited for use as aerospace structural components such as, for example, flap tracks, actuators, engine mounts, and landing gear hardware. These properties, along with various manufacturing considerations, are strongly influenced by alloy composition, structure, heat treatment, and level of process control in the alloy systems. To obtain the properties necessary for high performance applications, careful and strict control of the alloying components and their concentrations and ratios is generally required. Even slight variations in the identities, concentrations, or ratios of alloying components can significantly affect the properties and performance of these stainless steel alloys.

For example, early forms of martensitic stainless steel alloys employed copper as the major hardening element. Alloys 17-4PH and 15-5PH, for example, were developed by coupling copper addition with high chromium levels and moderate levels of nickel. These early forms of steel alloys are recognized as having good corrosion and SCC resistance, but have been found to have relatively low yield strength levels (YS<180 ksi). Because of the relatively inferior strength properties exhibited by martensitic stainless steel alloys including copper additions, copper has not been favored as a major strengthening element in high strength stainless steel alloys.

Other martensitic stainless steel alloys have been developed that employ various levels of aluminum to enhance strength. These alloys can exhibit yield strength greater than 200 ksi in the H950 condition (i.e., aged at an aging temperature of 950° F.), along with good ductility and toughness. However, the strength of this type of martensitic steel is still relatively low and may be insufficient for many high strength applications. Other martensitic stainless steel alloys have been developed that employ both aluminum and copper as strengthening elements. These alloys exhibit much higher strengths (YS≧235 ksi), but fail to achieve acceptable levels of fracture toughness ($K_{IC}$<65 ksi·in$^{1/2}$).

Other approaches to forming martensitic stainless steel alloys involve the addition of titanium as the major strengthening element along with various levels of copper as the secondary strengthener, and providing a suitable nickel-chromium equivalence. Alloys formulated by these approaches provide relatively high strength (YS>240 ksi) and good corrosion resistance, but exhibit low toughness (Charpy V-notch impact toughness (CVN)<10 ft/lb and $K_{IC}$<65 ksi·in$^{1/2}$).

More recent developments include the addition of relatively high levels of titanium (1.5%-1.8% by weight) and nickel, which achieves high toughness, but at the possible expense of corrosion resistance and SCC resistance due to nickel/chromium imbalance. These alloying systems also involve a costly and time consuming cryogenic treatment step after solution heat treatment in order to achieve their high performance properties.

Still other high strength martensitic steel alloys employ a combination of aluminum and titanium as strengthening agents. These alloys can be divided into two groups: 1) alloys that employ relatively low levels of aluminum and titanium and exhibit relatively high toughness; and 2) alloys that employ relatively higher levels of aluminum and titanium and exhibit relatively high strength. However, it has been found that the steel alloys of this type that exhibit high strength generally exhibit low toughness, with Charpy impact energies of only a few foot-pounds and facture toughness less than 60 ksi·in$^{1/2}$ at room temperature.

More recently developed alloys, such a Custom 465® alloy and MLX17 alloy, exhibit both high strength and high toughness, include relatively high levels of aluminum and titanium hardening elements, and also include increased levels of the toughening element nickel. The concentration of nickel in these alloys, however, is increased to a level at which conventional solution-age treatments cannot be used, and expensive post-solution treatment cryogenic processing is required to obtain the increased mechanical properties.

Other approaches to formulating high strength steel alloys involve additions of one or more of silicon, beryllium, and molybdenum as hardening elements to form steel alloys with very high strength, but low toughness. Because of their low toughness properties, these steel alloys typically are unsuitable for high performance structural applications.

A relatively new stainless steel that achieves high toughness and high strength without the requirement for cryogenic treatment is disclosed in U.S. Pat. App. Pub. No. 2005/0126662 ("the '662 publication), which is hereby incorporated by reference herein in its entirety. The '662 publication discloses a precipitation hardening martensitic stainless steel alloy that exhibits excellent mechanical properties and high corrosion/stress corrosion cracking (SCC) resistance. The '662 publication's stainless steel includes controlled amounts of aluminum, copper, and titanium as hardening elements, together with carefully adjusted matrix chemistry, especially relating to levels of chromium, molybdenum, nickel, and, optionally, tungsten, boron, and carbon. This stainless steel can be processed by a conventional solution-age treatment without using expensive and time-consuming cryogenic treatments, as are required with some of the newly developed precipitation hardening martensitic stainless steels. While the corrosion/SCC resistance properties of the precipitation hardening martensitic stainless steel disclosed in the '662 publication are equal to or better than those of the newer, cryogenic-treated stainless steels, the ultimate tensile strength of the alloy disclosed in the patent publication is slightly lower at lower aging temperature conditions.

Accordingly, there continues to be a need for precipitation hardening martensitic stainless steels having advantageous mechanical properties that render the alloys suitable for certain high performance applications.

SUMMARY

A thermal mechanical treatment method is disclosed for a precipitation hardening martensitic stainless steel. An embodiment of the method according to the present disclosure includes hot working a precipitation hardening martensitic stainless steel, quenching the stainless steel, and aging the stainless steel. The stainless steel is not solution heat treated prior to aging the stainless steel. In an embodiment, the stainless steel is not cryogenically cooled as part of the thermal mechanical treatment method.

In a non-limiting embodiment of the method according to the present disclosure, hot working may include at least one of forging, piercing, rolling, and extruding. In another embodiment, hot working may include any metallurgical hot working process known now or hereinafter to a person having ordinary skill in the metallurgical arts. A non-limiting embodiment may include hot working the stainless steel by a process including a final hot working pass at a hot working temperature that is greater than the recovery temperature of the stainless steel. An embodiment may include a final hot working pass reduction of the precipitation hardening martensitic stainless steel alloy of 15% to 70%.

Non-limiting embodiments of quenching include water quenching and ice water quenching. A non-limiting embodiment includes water quenching followed by ice water quenching.

Aging may include heating the stainless steel for an aging time and at an aging temperature that are sufficient to precipitate at least one hardening phase in the stainless steel. A non-limiting embodiment includes heating at an aging temperature of about 950° F. and for an aging time of about 4 hours. Still another non-limiting embodiment includes heating at an aging temperature of about 1000° F. and for an aging time is about 4 hours.

In a non-limiting embodiment, the precipitation hardening martensitic stainless steel processed by the method according to the present disclosure has a composition comprising, in percent by weight: 11.0% to 12.5% chromium; 1.0% to 2.5% molybdenum; 0.15% to 0.5% titanium; 0.7% to 1.5% aluminum; 0.5% to 2.5% copper; 9.0% to 11.0% nickel; up to 0.02% carbon; up to 2.0% tungsten; up to 0.001% boron; iron; and incidental impurities. In another embodiment, the precipitation hardening martensitic stainless steel may be selected from the group consisting of UNS S13800, UNS S14800, UNS S15500, UNS S17400, UNS S45000, UNS S45500, and UNS S46500.

The present disclosure also is directed to an article or a part of an article made of or comprising a precipitation hardening martensitic stainless steel that has a process history that includes hot working the stainless steel, quenching the stainless steel, and aging the stainless steel, wherein the stainless steel is not solution heat treated prior to aging. Non-limiting embodiments of a process history for the precipitation hardening martensitic stainless steel include the method embodiments disclosed herein.

A non-limiting embodiment according to the present disclosure includes an article or part of an article processed as indicated herein that has a composition, in percent by weight, comprising: 11.0% to 12.5% chromium; 1.0% to 2.5% molybdenum; 0.15% to 0.5% titanium; 0.7% to 1.5% aluminum; 0.5% to 2.5% copper; 9.0% to 11.0% nickel; up to 0.02% carbon; up to 2.0% tungsten; up to 0.001% boron; iron; and incidental impurities. In another non-limiting embodiment, the article or part having the disclosed process history may have a composition selected from the group consisting of UNS S13800, UNS S14800, UNS S15500, UNS S17400, UNS S45000, UNS S45500, and UNS S46500.

A non-limiting embodiment of an article comprising a precipitation hardening martensitic stainless steel having a process history disclosed herein may include an aerospace structural component. Non-limiting embodiments of such an aerospace structural component include a flap track, an actuator, an engine mount, and a landing gear component.

BRIEF DESCRIPTION OF THE DRAWINGS

The features and advantages of alloys, articles, and methods described herein may be better understood by reference to the accompanying drawings in which.

Figure 1A:
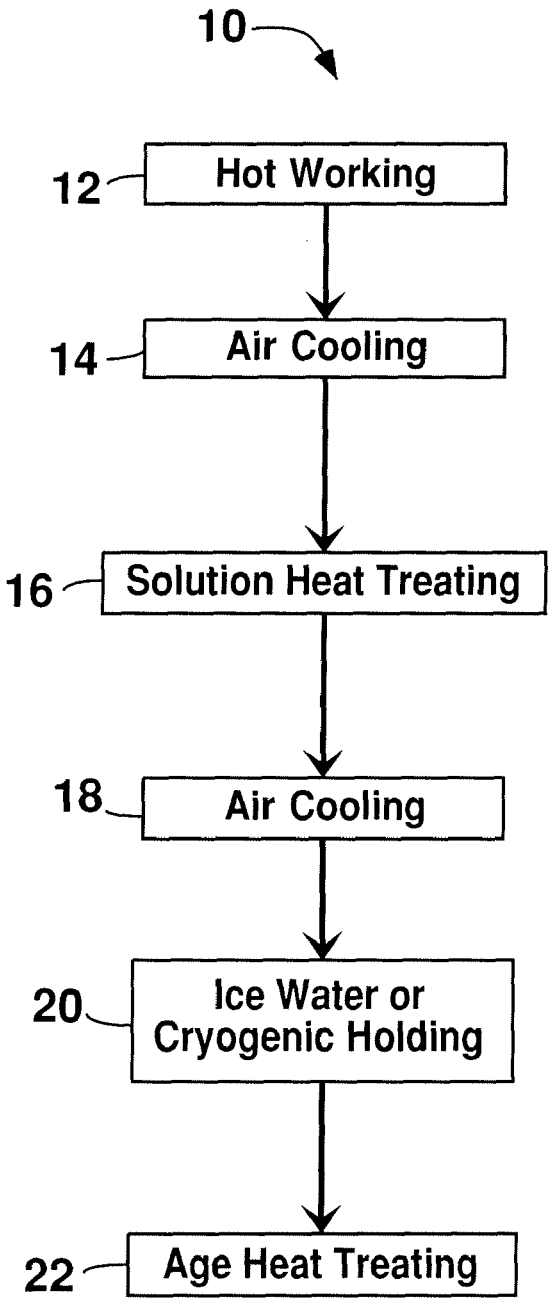
FIG. 1A Prior Art
FIG. 1A is flow chart of a conventional thermal mechanical process for strengthening precipitation hardening martensitic stainless steel.

The reader will appreciate the foregoing details, as well as others, upon considering the following detailed description of certain non-limiting embodiments according to the present disclosure.

DETAILED DESCRIPTION OF CERTAIN NON-LIMITING EMBODIMENTS

In the present description of non-limiting embodiments, other than in the operating examples or where otherwise indicated, all numbers expressing quantities or characteristics are to be understood as being modified in all instances by the term "about". Accordingly, unless indicated to the contrary, any numerical parameters set forth in the following description are approximations that may vary depending on the desired properties one seeks to obtain in the precipitation hardening stainless steels and methods according to the present disclosure. At the very least, and not as an attempt to limit the application of the doctrine of equivalents to the scope of the claims, each numerical parameter should at least be construed in light of the number of reported significant digits and by applying ordinary rounding techniques.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

The word "about" as used herein with respect to temperatures refers to a range of plus and minus 25° F. relative to the stated temperature. The word "about" as used herein with respect to times refers to a range of plus and minus 15 minutes relative to the stated time. For example, as used herein, "about 100° F." refers to a temperature range of 75-125° F., and "about 1 hour" refers to a time range of about 45-75 minutes. Other values for properties qualified by the word "about" herein should be understood to refer to a range within values of plus and minus 10% of the stated value.

The present inventors determined that mechanical properties of precipitation hardening stainless steels can be improved by a process that includes hot working, followed by direct quenching and subsequent aging, and without using a traditional solution heat treatment step. Precipitation hardening martensitic stainless steels treated according to embodiments disclosed herein exhibited mechanical properties and corrosion/SCC resistance, at any aging condition, that is comparable with, or superior to, those properties of more expensive precipitation hardening martensitic stainless steels that require expensive cryogenic treatments. Considerable expense and time are saved in embodiments disclosed herein by not requiring that the precipitation hardening martensitic stainless steel undergo solution heat treating to develop suitable mechanical properties.

Referring to FIG. 1A, a flow chart depicting a conventional thermal mechanical treatment process 10 for strengthening precipitation hardening martensitic stainless steel is shown. Conventionally, a precipitation hardening martensitic stainless steel form is subjected to hot press working, such as, but not limited to, hot press forging 12. The forged precipitation hardening martensitic stainless steel is air cooled 14. After air cooling 14, the precipitation hardening martensitic stainless steel is solution heat treated 16. Solution heat treating 16 is conducted at a temperature and for a time so that a single phase is formed. The solution heat treated precipitation hardening martensitic stainless steel is then air cooled 18, and is subsequently held in ice water or at a cryogenic temperature 20. After the ice water or cryogenic treatment 20, the precipitation hardening martensitic stainless steel is subjected to a precipitation aging treatment 22 for precipitation of the strengthening phases in the precipitation hardening martensitic stainless steel.

Figure 1B:
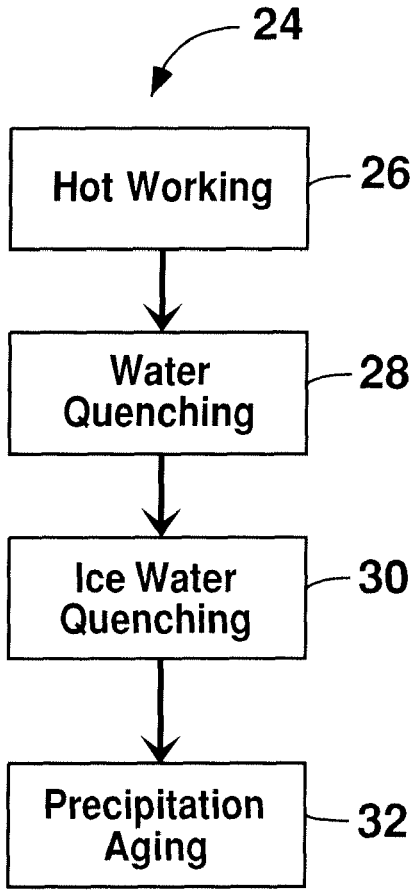
FIG. 1B is a flow chart of an exemplary embodiment of a novel hot working/direct quenching and aging treatment method for a precipitation hardening martensitic stainless steel disclosed herein.
Figure 2:
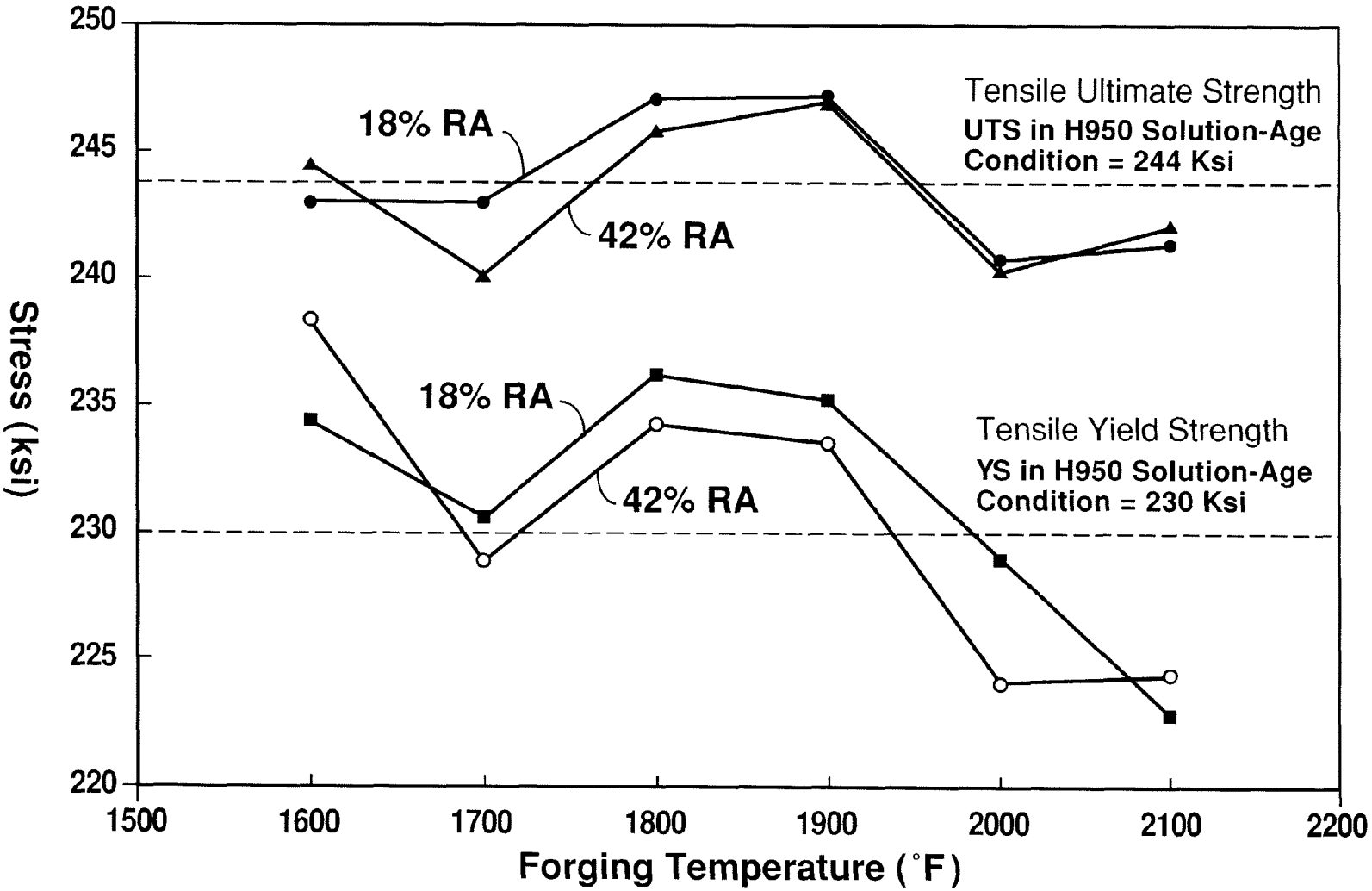
FIG. 2 is a plot of tensile strength versus forging temperature for an embodiment of a hot worked/direct aged precipitation hardening martensitic stainless steel in H950 condition, as described herein.
Figure 3:
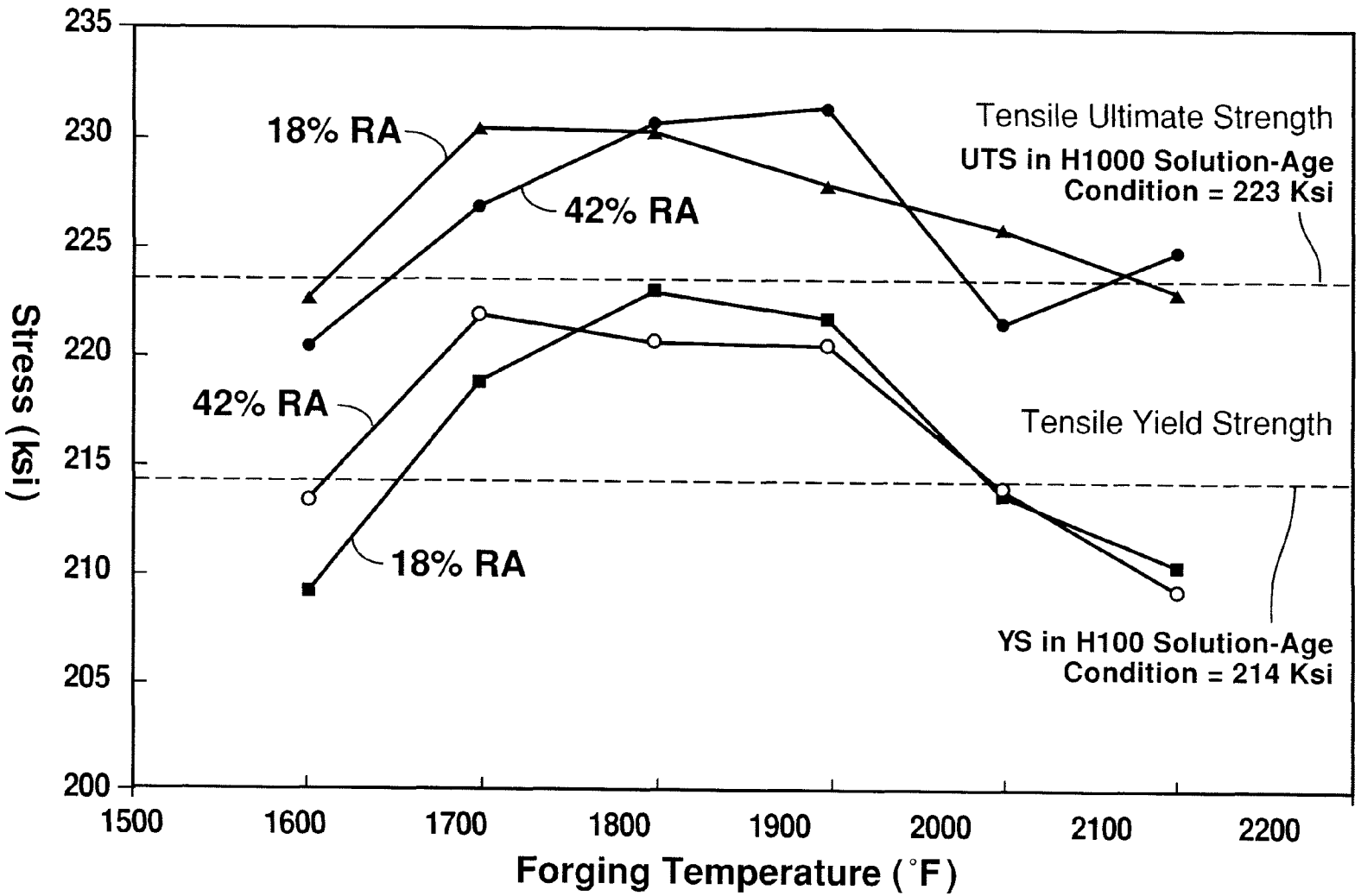
FIG. 3 is a plot of tensile strength versus forging temperature for an exemplary embodiment of a hot worked/direct aged precipitation hardening martensitic stainless steel in H1000 condition, as described herein.
Figure 4:
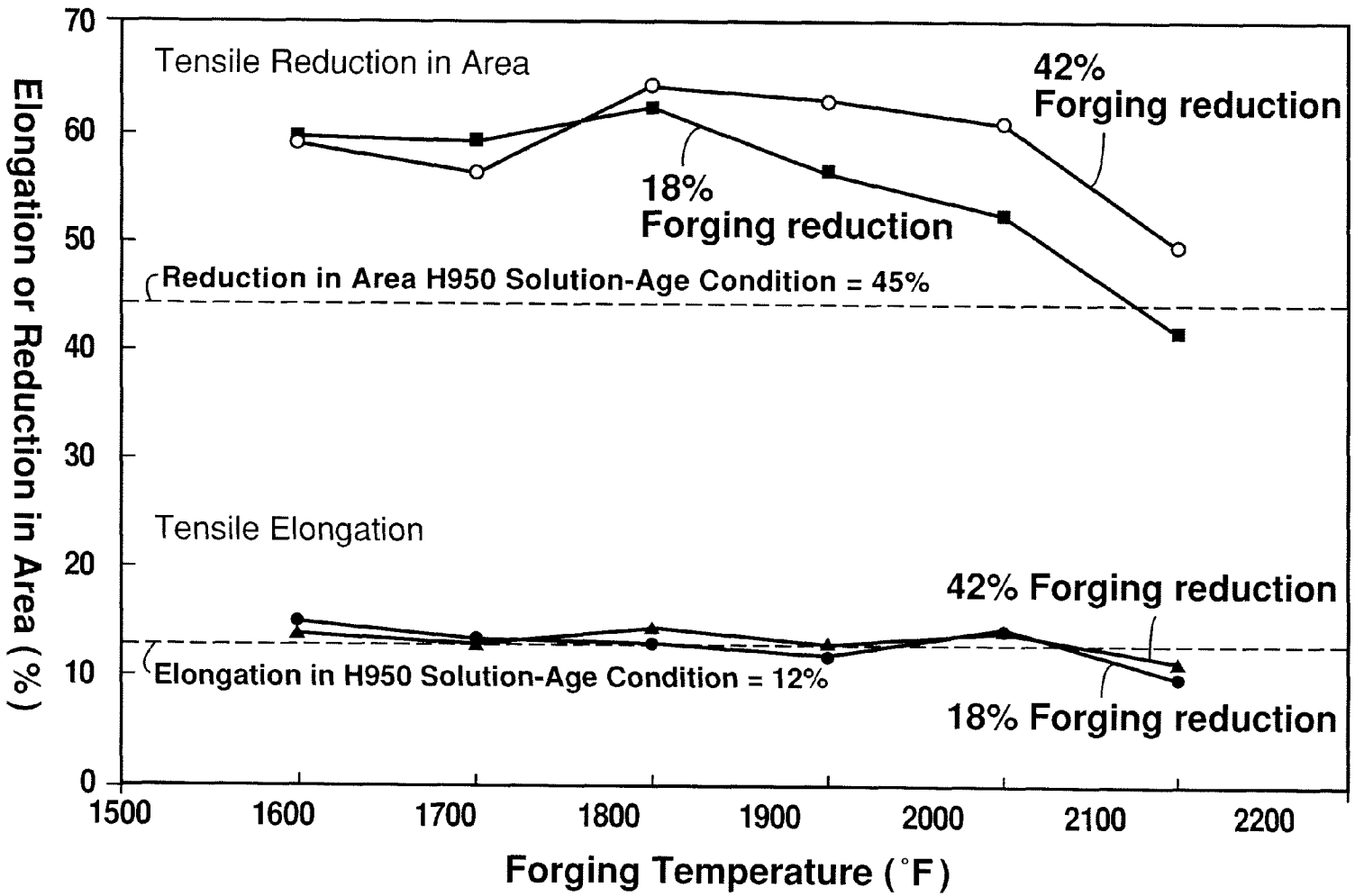
FIG. 4 is a plot of elongation or reduction in area versus forging temperature for an exemplary embodiment of a hot worked/direct aged precipitation hardening martensitic stainless steel in H950 condition, as described herein.
Figure 5:
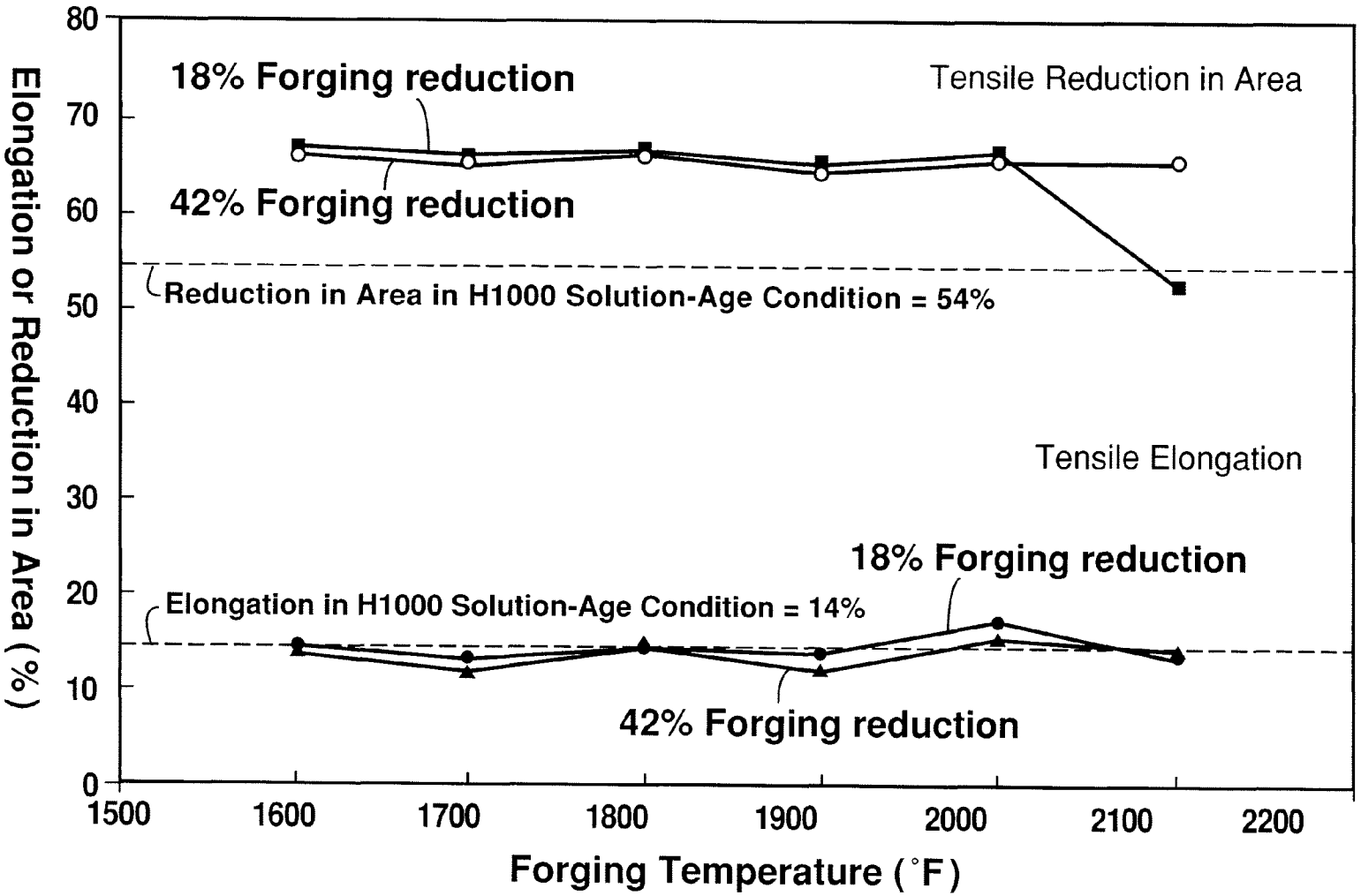
FIG. 5 is a plot of elongation or reduction in area versus forging temperature for an exemplary embodiment of a hot worked/direct aged precipitation hardening martensitic stainless steel in H1000 condition, as described herein.

Referring now to FIG. 1B, in an exemplary non-limiting embodiment of a thermal mechanical treatment 24 according to the present disclosure, a precipitation hardening martensitic stainless steel billet, ingot, or other form may be hot press forged 26. The forged precipitation hardening martensitic stainless steel may be water quenched 28. Water quenching 28 may be followed by an ice water hold 30. After ice water holding 30, the precipitation hardening martensitic stainless steel undergoes precipitation aging treatment 32 for controlled precipitation of strengthening phases.

As is known in the art, hot working refers to deforming a metal or metal alloy plastically at a specific temperature and strain rate so that recrystallization and deformation are simultaneous, thus avoiding any strain hardening. In a non-limiting embodiment of the present method, hot working includes plastically deforming a precipitation hardening martensitic stainless steel at a temperature of about sixth-tenths of the steel's melting temperature ($0.6T_m$). In another embodiment, hot working includes plastically deforming a precipitation hardening martensitic stainless steel above the recovery temperature of the precipitation hardening martensitic stainless steel. In yet another embodiment, hot working includes plastically deforming a precipitation hardening martensitic stainless steel above its recrystallization temperature.

Recovery is a process by which deformed grains in metals and metal alloys can reduce stored energy by the removal or rearrangement of defects in the metals' or alloys' crystal structures. The defects are primarily dislocations that are introduced by plastic deformation of the material. Recovery and recrystallization are similar processes, as both are driven by stored energy in the material, but it is generally agreed that recovery takes place without the migration of high-angle grain boundaries, as occurs during recrystallization. Recovery and recrystallization temperatures are dependent upon alloy composition and are determinable by an ordinarily skilled practitioner without undo experimentation.

Heavily deformed metals and metal alloys can contain a large number of dislocations. However, during plastic deformation above the recovery temperature, dislocations generally annihilate one another. Recovery that occurs during hot working is referred to as "dynamic" recovery.

Dislocations become highly mobile beginning at about three-tenths of the absolute melting temperature ($0.3T_m$) of the metal or metal alloy. The dislocations are able to glide, cross-slip, and climb. When two dislocations of opposite sign meet, they effectively cancel out and their contribution to stored energy is removed.

While not meaning to be bound by any theory, it is believed that when a precipitation hardening martensitic stainless steel is plastically deformed at a defined temperature or temperature range with a particular strain rate, residual dislocations may survive the hot working and form various types of dislocation substructures or subgrain structures. Rapid cooling of the precipitation hardening martensitic stainless steel after elevated-temperature working may inhibit recrystallization, and preserve the substructure that resulted from hot working. During subsequent precipitation aging, strengthening phases may nucleate at sites concurring with the residual substructure. Considering a substructure that may be highly distributed in the grains, a high density of nucleation sites may exist that promote nucleation and growth of fine and dispersed strengthening phase particles during the controlled aging of the metal or metal alloy.

Efforts have been made to improve the mechanical properties of precipitation hardening martensitic stainless steel using plastic deformation. These processes, however, use heavily cold worked solution-treated steel to generate a high density of dislocations. The steel is then aged to form fine precipitates. Another technique involves an intercritical annealing step between cold working and aging. In an intercritical annealing step, a very fine duplex martensite-austenite structure forms during heating in the temperature range between the starting temperature of reverse transformation from martensite to austenite ($A_s$) and the finishing temperature of reverse transformation ($A_f$). This leads to improvement in mechanical properties, and particularly in improved ductility and toughness. However, each of these techniques involves heavy cold working, which limits the application of these techniques. Only components with simple geometries, such as wire, rod, sheet, and plate, and components with small cross-sections can be readily processed by heavy cold working. Embodiments disclosed herein rely only on plastic deformation using hot working, and thus are applicable to all mill product or finished product forms.

Hot working, or hot plastic working, may include all commercial means, such as, but not limited to, forging (including open and closed die forging), piercing, rolling, and extruding.

It was discovered that it is only critical to control the working temperature and reduction of the final pass, i.e., the last hot working step, in a hot working process. Hot working prior to the final pass can be conducted at wide ranges of temperature and reduction combinations before the final pass.

In one non-limiting embodiment according to the present disclosure, the final pass of a hot working process may involve plastic deformation of the precipitation hardening martensitic stainless steel at temperatures in a range of from about 1500° F. to about 2100° F. In another embodiment, the final pass hot working temperature may be from about 1500° F. to about 1800° F., from about 1600° F. to about 1900° F., or from about 1600° F. to about 2000° F. In still another embodiment, the final pass hot working temperature may be from about 1700° F. to about 1900° F., or from about 1700° F. to about 1850° F.

It was also determined that the percent reduction of the final hot working pass influences the mechanical properties of the precipitation hardening martensitic stainless steel thermo-mechanically treated according to embodiments herein. In one embodiment, a final pass reduction may be from about 15% to about 70%. In another embodiment, a final pass reduction may be from about 18% to about 42%. In an embodiment adapted for long products such as, but not limited to, bar products, percent reduction in a final pass may refer to reduction in cross-sectional area of the bar. In another embodiment, for flat products such as, but not limited to, sheet products, percent reduction in a final pass may refer to reduction in thickness.

After hot working, the precipitation hardening martensitic stainless steel is quenched. Non-limiting quenching techniques may include water quenching, quenching with an aqueous solution (such as, for example, brine), oil quenching, or quenching in a mixture of water and oil. In one non-limiting embodiment, the initial temperature of the quenching bath may be about 65° F. In another embodiment, the temperature of the quench bath does not exceed about 100° F. Other types of baths and quench bath temperatures known now or hereinafter by a person having ordinary skill in the art are within the scope of embodiments herein. In one non-limiting embodiment, the precipitation hardening martensitic stainless steel is quenched until the temperature of the steel is no greater than about 300° F.

Following quenching, according to one non-limiting embodiment of the process of the present disclosure, the precipitation hardening martensitic stainless steel is immersed in ice water and held in the ice water for a period (holding time) of at least about two hours. In a non-limiting embodiment, holding times may be about 2 hours to about 24 hours. Longer holding times are acceptable and are within the scope of embodiments of this disclosure. It is contemplated that any means of holding the precipitation hardening martensitic stainless steel at a temperature below about 50° F. is within the scope of embodiments herein. In one non-limiting embodiment, the precipitation hardening martensitic stainless steel may be held at a temperature in the range of ice water temperature or no greater than about 40° F. While not wishing to be bound by any theory, it is believed that holding the precipitation hardening martensitic stainless steel at about the temperature of ice water (from about 33° F. to about 40° F.) stabilizes the residual substructure that forms during the hot plastic deformation of the hot working step. It is noted that treatments at cryogenic temperature are not necessary for practice of embodiments herein. Cryogenic temperature is generally recognized as a temperature lower than about −40° F. (−40° C.). According to non-limiting embodiments of the present disclosure, following quenching the precipitation hardening martensitic stainless steel may be held at temperatures in a range from about −40° F. to about 50° F., from about −30° F. to about 50° F., from about −20° F. to about 40° F., from about −10° F. to about 40° F., from about 0° F. to about 40° F., or from about −40° F. to about °40° F.

After holding the precipitation hardening martensitic stainless steel in ice water or at a temperature less than ambient temperature, the precipitation hardening martensitic stainless steel is aged at an elevated temperature. Aging, also referred to as precipitation aging or age hardening, provides a controlled precipitation of strengthening particles in the martensitic steel matrix. Aging, as disclosed herein, results in precipitation of fine strengthening particles distributed throughout the martensitic grains.

In certain non-limiting embodiments, aging temperatures may range from about 800° F. to about 1200° F., from 850° F. to about 1100° F., or from 900° F. to about 1050° F. In another embodiment, aging temperatures may range from about 950° F. to about 1000° F. In yet another embodiment, an aging temperature may be about 950° F. In still yet another embodiment, an aging temperature may be about 1000° F. It is recognized that "aging", as the term is used herein, includes multiple aging steps at different temperatures, which may be used advantageously to improve mechanical properties of the precipitation hardening martensitic stainless steels.

Aging times may be, for example, about 4 hours or less. Other possible aging times and temperatures may be determined for specific alloys by one of ordinary skill in the art without undue experimentation, and are within the scope of the methods according to the present disclosure. Aging may include heating the precipitation hardening martensitic stainless steel with any combination of aging time and aging temperature that is sufficient for the precipitation of one or more hardening phases. In one non-limiting embodiment, for example, the aging temperature is about 950° F. and the aging time is about 4 hours. In another non-limiting embodiment, the aging temperature is about 1000° F. and the aging time is about 4 hours. In yet another non-limiting embodiment, the aging temperature is about 1050° F. and the aging time is about 4 hours.

A non-limiting example of a martensitic stainless steel alloy that benefits from embodiments of methods herein is an alloy comprising: about 11.0% to about 12.5% chromium; about 1.0% to about 2.5% molybdenum; about 0.15% to about 0.5% titanium; about 0.7% to about 1.5% aluminum; about 0.5% to about 2.5% copper; about 9.0% to about 11.0% nickel; up to about 0.02% carbon; up to about 2.0% tungsten; up to about 0.001% boron; iron; and incidental impurities. (As used herein, "up to" includes the absence of the indicated element, unless some concentration of the element would necessarily be present in the alloy.) However, it is anticipated that any precipitation hardening martensitic stainless steel, including, but not limited to, PH13-8Mo stainless steel (UNS S13800), 15-5 PH alloy (UNS S15500) and Custom 465® stainless steel (UNS S46500), will benefit from methods according to the present disclosure.

An embodiment of an article according to the present disclosure includes a precipitation hardening martensitic stainless steel alloy that has a process history including: hot working the precipitation hardening martensitic stainless steel alloy; quenching the precipitation hardening martensitic stainless steel alloy; and aging the precipitation hardening martensitic stainless steel alloy; without a solution heat treatment step prior to the aging step. The precipitation hardening martensitic stainless steel alloy is not subjected to a cryogenic treatment. In one non-limiting example, the precipitation hardening martensitic stainless steel of the article, having the foregoing process history, may have a composition that includes, in percent by weight: about 11.0% to about 12.5% chromium; about 1.0% to about 2.5% molybdenum; about 0.15% to about 0.5% titanium; about 0.7% to about 1.5% aluminum; about 0.5% to about 2.5% copper; about 9.0% to about 11.0% nickel; up to about 0.02% carbon; up to about 2.0% tungsten; up to about 0.001% boron; iron; and incidental impurities. One precipitation hardening martensitic stainless steel having this composition is available from ATI Allvac, Monroe, N.C. as ATI® S240® alloy.

In an embodiment, a precipitation hardening martensitic stainless steel processed according to the methods disclosed herein may be selected from all precipitation hardening martensitic stainless steels known now or hereinafter to a person having ordinary skill in the metallurgical arts. In one non-limiting embodiment, the precipitation hardening martensitic stainless steel processed according to the methods disclosed herein may be selected from the group consisting of alloys having UNS numbers S13800, S15500, and S46500. In another non-limiting embodiment, the precipitation hardening martensitic stainless steel processed according to methods disclosed herein may be selected from the group consisting of alloys having UNS numbers S13800, S14800, S15500, S17400, S45000, S4550, and S46500. In yet another non-limiting embodiment, the precipitation hardening martensitic stainless steel processed according to methods disclosed herein is a UNS S13800 alloy. In still yet another non-limiting embodiment, the precipitation hardening martensitic stainless steel processed according to the methods disclosed herein is a UNS S15500 alloy. In still another non-limiting embodiment, the precipitation hardening martensitic stainless steel processed according to the methods disclosed herein is a UNS S46500 alloy.

Non-limiting examples of an article including a precipitation hardening martensitic stainless steel having the novel process history disclosed herein may include, for example, an aerospace structural component, such as, but not limited to, a flap track, an actuator, an engine mount, and a landing gear component.

EXAMPLE 1

4 inch RD bars of a precipitation hardening martensitic stainless steel available commercially as ATI® S240® alloy were press-forged to an intermediate size of 2 inch×4 inch cross-section bars. The intermediate-size bars were forged down to 1.75 inch wide×3.5 inch thick slabs in a finishing final pass at 2000° F. with a reduction of 18%. The slabs were divided into two equal groups. The slabs of one group were cooled to ambient temperature in air and were solution heat treated at 1700° F. for 1 hour. Half of the solution treated steel was aged at 950° F. for 4 hours (H950), and the other half was aged at 1000° F. for 4 hours (H1000). The slabs of the remaining group of slabs, after the finishing final pass, were quenched in water and then in ice water, and aged in the same way as the solution heat treated steel (one half at H950 and one half at H1000).

Standard tensile and toughness tests were conducted on the treated steels. Table 1 lists the test results from the steel treated in Example 1. Each data point is the average of two tests.

TABLE 1

| | Thermal Mechanical Treatment | | | Tensile Properties | | | | Charpy | |
|---|---|---|---|---|---|---|---|---|---|
| Process | Hot Working | Solution Heat Treating | Aging | UTS ksi | YS ksi | EL % | RA % | Impact ft-lbs | $K_{IC}$ ksi · in$^{1/2}$ |
| Comparative | 2000° F., 18% RA air cool | 1700° F. for 1 hr; ice water quench | 950° F. for 4 hrs | 243.6 | 231.4 | 11.7 | 45.7 | 18.5 | 77.7 |
| Experimental | 2000° F., 18% RA ice water quench | None | | 240.2 | 228.1 | 13.3 | 49.0 | 23 | 92.8 |
| Comparative | 2000° F., 18% RA air cool | 1700° F. for 1 hr; ice water quench | 1000° F. for 4 hrs | 222.7 | 214.2 | 15.3 | 61.3 | 29.5 | 98.6 |
| Experimental | 2000° F., 18% RA ice water quench | None | | 220.4 | 211.8 | 17.6 | 68.8 | 55.5 | 111.3 |

The data in Table 1 show that the evaluated embodiments of the novel thermal mechanical treatment according to the present disclosure did not significantly affect tensile strength versus conventional processing, but did significantly improve tensile ductility and toughness versus conventional processing as evaluated for the ATI® 240® alloy.

EXAMPLE 2

Additional test trials were conducted to further evaluate the optimum combination of hot working temperature and strain levels for the hot work/quench/age process. The steel and initial forging conditions were the same as in Example 1. Final pass forging temperatures were varied, ranging from 1600° F. to 2100° F. Two final pass forging reductions of 18% and 42% were applied to check the effect of plastic strain. The results of tensile and toughness testing are presented in Table 2 and graphically in FIGS. 2-7. Each data point is the average of two tests.

TABLE 2

| Hot Working | | | Tensile Properties | | | | Charpy | |
|---|---|---|---|---|---|---|---|---|
| Temperature | Reduction in Area | Aging | UTS ksi | YS ksi | EL % | RA % | Impact ft-lbs | $K_{IC}$ ksi · in$^{1/2}$ |
| 2100° F. | 18% | H950 | 241.5 | 222.8 | 10.0 | 42.1 | 16 | 90.3 |
| | | H1000 | 224.7 | 210.2 | 13.5 | 53.0 | 28.5 | 100.5 |
| | 42% | H950 | 242.2 | 224.4 | 11.5 | 50.0 | 26.5 | 88.7 |
| | | H1000 | 222.9 | 209.0 | 14.5 | 65.8 | 44 | 112.3 |
| 2000° F. | 18% | H950 | 240.9 | 229.0 | 14.4 | 52.8 | 18 | 91 |
| | | H1000 | 221.4 | 213.5 | 17.3 | 66.7 | 55 | 110.3 |
| | 42% | H950 | 240.4 | 224.1 | 14.5 | 61.0 | 30.5 | 93.3 |
| | | H1000 | 225.8 | 213.8 | 15.5 | 65.9 | 42.5 | 123.1 |
| 1900° F. | 18% | H950 | 247.3 | 235.3 | 12.0 | 56.7 | 26.5 | 93.1 |
| | | H1000 | 231.4 | 221.6 | 14.0 | 65.4 | 37.5 | 107.8 |
| | 42% | H950 | 247.1 | 233.6 | 13.0 | 63.2 | 31 | 92.9 |
| | | H1000 | 227.8 | 220.4 | 12.0 | 64.4 | / | 116.0 |
| 1800° F. | 18% | H950 | 247.2 | 236.3 | 13.0 | 62.5 | 31 | 96.1 |
| | | H1000 | 230.6 | 222.9 | 14.5 | 66.8 | 39.5 | 122.8 |
| | 42% | H950 | 245.9 | 234.3 | 14.5 | 64.6 | 33 | 107.2 |
| | | H1000 | 230.2 | 220.6 | 15.0 | 66.4 | 49.5 | 119.7 |
| 1700° F. | 18% | H950 | 243.1 | 230.6 | 13.5 | 59.5 | 36.5 | 91.0 |
| | | H1000 | 226.8 | 218.8 | 13.3 | 66.3 | 61 | 136.4 |
| | 42% | H950 | 240.2 | 228.9 | 13.0 | 56.5 | 33 | 96.0 |
| | | H1000 | 230.4 | 221.8 | 11.8 | 65.1 | 56 | 123.4 |
| 1600° F. | 18% | H950 | 243.1 | 234.4 | 15.0 | 59.7 | 48.5 | 89.7 |
| | | H1000 | 220.4 | 209.1 | 14.7 | 67.1 | 59.5 | 137.8 |
| | 42% | H950 | 244.6 | 238.4 | 14.0 | 59.4 | 35 | 96.0 |
| | | H1000 | 222.6 | 213.3 | 14.0 | 66.5 | 71.5 | 136.4 |

Figure 6:
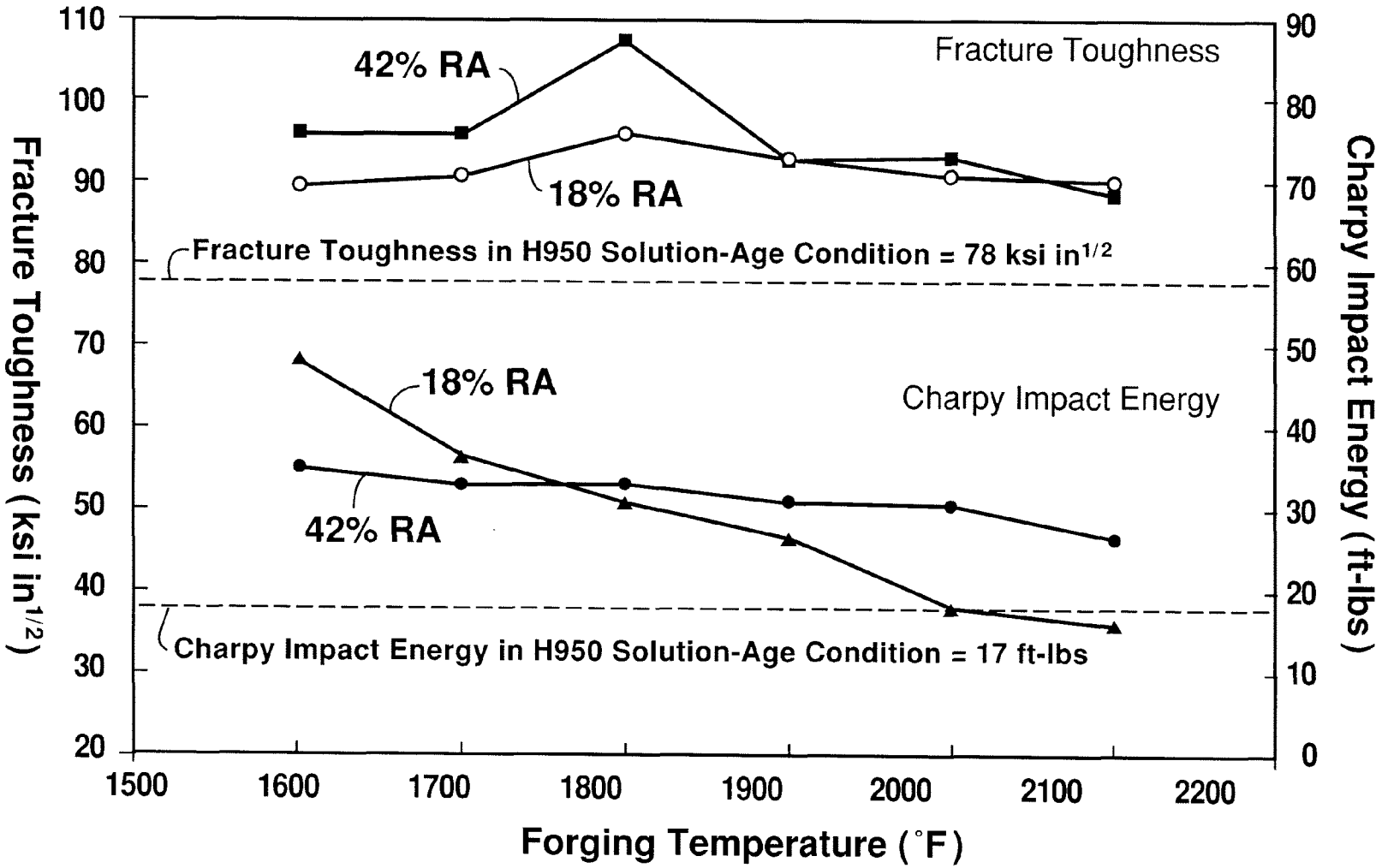
FIG. 6 is a plot of fracture toughness versus forging temperature for an exemplary embodiment of a hot worked/direct aged precipitation hardening martensitic stainless steel in H950 condition, as described herein.
Figure 7:
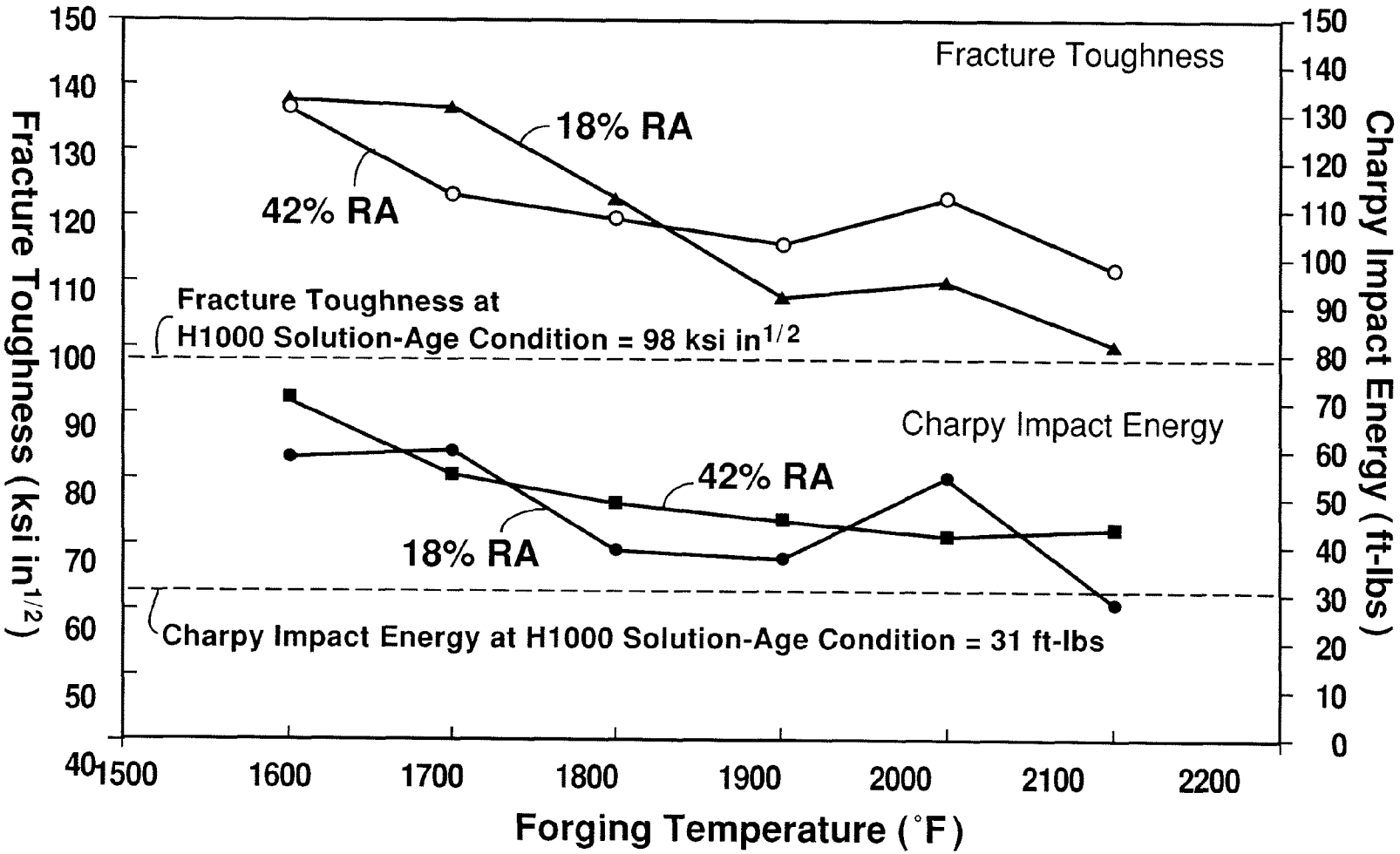
FIG. 7 is a plot of fracture toughness versus forging temperature for an exemplary embodiment of a hot worked/direct aged precipitation hardening martensitic stainless steel in H1000 condition.

As FIGS. 2-5 show, tensile strength of ATI® S240® alloy at both H950 and H1000 conditions can be increased by the hot work/quench/age process according to the present disclosure, with hot working in the range of 1700° F. to 1900° F., as compared with steel processed using standard solution heat treatment and aging. Even more dramatic improvements were observed in tensile ductility, especially in reduction in area. The improvement in toughness over conventional solution-age treatments is particularly evident. As depicted in FIGS. 6-7, both notch toughness (Charpy impact) and fracture toughness were significantly improved using an embodiment of the hot work/quench/age process according to the present disclosure in comparison with the evaluated conventional solution-age process. Based on these results, it appears that forging reduction (plastic strain) has a minor effect on the mechanical properties of alloys processed by a hot work/quench/age process according to the present disclosure.

The data in the previous examples demonstrate that the hot work/quench/age thermal mechanical method according to the present disclosure can effectively improve the mechanical properties of ATI® S240® alloy compared with alloy processed by a conventional solution-age process. The improvements in tensile ductility and toughness are particularly evident. With these observed improvements in mechanical properties, ATI® S240® alloy meets all of the mechanical property specifications for certain more expensive precipitation hardening martensitic stainless steels.

The effect of the novel hot work/quench/age thermal mechanical process according to the present disclosure is observed over a wide range of hot working temperatures and reductions. This suggests that the process window of the novel hot work/quench/age thermal mechanical process is wide enough to be readily implemented in commercial production.

EXAMPLE 3

Trials were also conducted on other high strength martensitic precipitation hardening stainless steels to determine if the novel thermal mechanical processing method described herein achieves similar results with those steels. Table 3 lists the results of trials performed on the widely used PH13-8Mo (UNS S13800) precipitation hardening martensitic stainless steel. It can be seen that the evaluated non-limiting embodiments of the novel hot work/quench/age process described herein also significantly improves the strength and toughness of PH13-8Mo alloy. Each data point is the average of two measurements.

TABLE 3

| | Thermal Mechanical Treatment | | | Tensile Properties | | | | Charpy | |
|---|---|---|---|---|---|---|---|---|---|
| | | Solution | | | | | | | |
| Process | Hot Working | Heat Treatment | Aging | UTS (ksi) | YS (ksi) | EL (%) | RA (%) | Impact (ft-lbs) | $K_{IC}$ (ksi · in$^{1/2}$) |
| Comparative | 1800° F. × 42% RA air cool | 1700° F. for 1 hr; ice water quench | 950° F. for 4 hrs | 228.2 | 214.9 | 13.4 | 52.1 | 19 | 55.0 |
| Experimental | 1800° F. × 42% RA ice water quench | None | | 235.2 | 221.8 | 16.0 | 72.9 | 30 | 68.6 |

TABLE 3-continued

| | Thermal Mechanical Treatment | | | Tensile Properties | | | | Charpy | |
|---|---|---|---|---|---|---|---|---|---|
| | | Solution | | | | | | | |
| Process | Hot Working | Heat Treatment | Aging | UTS (ksi) | YS (ksi) | EL (%) | RA (%) | Impact (ft-lbs) | $K_{IC}$ (ksi · in$^{1/2}$) |
| Comparative | 1800° F. × 42% RA air cool | 1700° F. for 1 hr; ice water quench | 1000° F. for 4 hrs | 210.5 | 203.8 | 13.2 | 59.5 | 28.5 | 87.8 |
| Experimental | 1800° F. × 42% RA ice water quench | None | | 214.1 | 209.8 | 15.5 | 73.6 | 65 | 95.3 |

EXAMPLE 4

A trial was conducted on Custom 465® alloy (UNS S46500). As described above, a cryogenic treatment after solution treatment is necessary for processing this steel due to its low martensitic transformation temperature ($M_s$), which results from the steel's nickel content and levels of other alloying elements. All slabs for this trial were formed from 2 inch by 4 inch bars that were prepared as in Example 1. In this trial, two processing routes were used. One processing route included cryogenic treatment in liquid nitrogen for 8 hours immediately after finishing forging at 1700° F., followed by aging at 950° F. (H950) or 1000° F. (H1000) for 4 hours. No cryogenic treatment was used in the alternate processing route. Instead, the forged steel was directly quenched in ice water in the same way as was done in the experimental processing of ATI® S240® alloy and PH13-8Mo alloy, described above. Each data point is the average of two tests. $K_{Ij}$ was measured on sub-sized, three-point bend samples and normally is slightly higher than the value for $K_{IC}$. The results from processing the Custom 465® alloy samples by both experimental processing routes are listed in Table 4, together with results obtained from conventional solution/age treatment processing with a post-solution cryogenic treatment.

TABLE 4

| | Thermal Mechanical Treatment | | | Tensile Properties | | | | Charpy | |
|---|---|---|---|---|---|---|---|---|---|
| | | Solution | | | | | | | |
| Process | Hot Working | Heat Treatment | Aging | UTS (ksi) | YS (ksi) | EL (%) | RA (%) | Impact (ft-lbs) | $K_{Ij}$ (ksi · in$^{1/2}$) |
| Comparative | 1800° F. × 30% air cool | 1800° F. × 1 hr + cryogenic treatment | 950° F. F for 4 hrs | 250.9 | 235.4 | 16.7 | 58.7 | 19 | 90.4 |
| Experimental | 1750° F. × 30% ice water quench + cryogenic treatment | None | | 257.8 | 245.6 | 15.5 | 58.2 | 23.5 | 102.5 |
| Experimental | 1750° F. × 30% ice water quench | None | | 256.3 | 249.1 | 14.6 | 59.8 | 27.5 | 96.2 |
| Comparative | 1800° F. × 30% air cool | 1800° F. × 1 hr + cryogenic treatment | 1000° F. for 4 hrs | 228.4 | 212.5 | 19.3 | 64.4 | 43 | 108 |
| Experimental | 1750° F. × 30% ice water quench + cryogenic treatment | None | | 234.4 | 224.9 | 17.6 | 62.8 | 41 | 135.4 |
| Experimental | 1750° F. × 30% RA ice water quench | None | | 233.8 | 223.4 | 17.8 | 63.2 | 42 | 139.4 |

The above results show that the evaluated novel hot work/quench/age process embodiments improved the mechanical properties of Custom 465® alloy. A moderate, yet significant improvement in strength was observed, along with increases in tensile ductility and toughness in samples processed by novel process embodiments described herein. Further, post-forging ice water cooling produced mechanical results almost identical to the post-forging cryogenic treatment, indicating that hot working may significantly increase the $M_s$ temperature of Custom 465® alloy, and cryogenic treatment is not be necessary for this alloy when using certain embodiments of the hot work/quench/age process according to the present disclosure. This advantage may provide considerable cost savings.

EXAMPLE 5

Table 5 lists the tensile properties and toughness results of trials performed on a 15-5 PH (UNS S15500) precipitation hardening martensitic stainless steel. A billet of 15-5 PH steel was purchased from a commercial warehouse. Pieces measuring 2.5 inch×2 inch×2 inch were cut from the billet material and heated at 2000° F. for 1 hour. Those pieces were upset forged from 2.5 inch thickness to 0.85 inch thickness for a 66% final pass reduction. One pancake was air cooled after forging. A second pancake was water quenched to room temperature, and then placed in an ice water bath for 4 hours.

The air cooled pancake was solution annealed at 1900° F. for 1 hour and air cooled. Test specimen blanks were cut from both pancakes and age hardened by heating at 1025° F. for 4 hours and air cooling. Tensile properties and toughness were measured at room temperature.

The results listed in Table 5 hereinbelow demonstrate that the novel direct aging process was effective for providing comparable tensile and toughness properties to conventional methods that require a solution heat treatment prior to aging. A moderate, yet significant improvement in strength was observed. Charpy impact values for the experimental direct aged samples were less than the traditional solution treated samples, however the fracture toughness of the direct aged samples was improved over those of the samples processed according to conventional heat treating processes that include a solution heat treatment.

TABLE 5

| | Thermal Mechanical Treatment | | | Tensile Properties | | | | Charpy | |
|---|---|---|---|---|---|---|---|---|---|
| Process | Hot Working | Solution Heat Treatment | Aging | UTS (ksi) | YS (ksi) | EL (%) | RA (%) | Impact (ft-lbs) | $K_{Ij}$ (ksi · in$^{1/2}$) |
| Comparative | 2000° F. 66% Reduction Air Cool | 1900° F. for 1 hour | 1025° F. for 4 hours | 161.65 | 157.05 | 17 | 68.2 | 79.5 | 123.8 |
| Experimental | 2000° F. 66% Reduction Ice Water Quench | None | | 172.95 | 167.3 | 17 | 66.1 | 64 | 131.1 |

Embodiments of the novel process disclosed herein could be used to improve mechanical properties of high strength martensitic precipitation hardening stainless steels and would simplify the processing of steels of this type. The novel hot work/quench/age process according to the present disclosure could find many applications for processing precipitation hardening martensitic stainless steels used in parts and structures requiring high strength and toughness and excellent corrosion/SCC resistance with wide ranges of geometries and cross-section dimensions.

It will be understood that the present description illustrates those aspects of the invention relevant to a clear understanding of the invention. Certain aspects that would be apparent to those of ordinary skill in the art and that, therefore, would not facilitate a better understanding of the invention have not been presented in order to simplify the present description. Although only a limited number of embodiments of the present invention are necessarily described herein, one of ordinary skill in the art will, upon considering the foregoing description, recognize that many modifications and variations of the invention may be employed. All such variations and modifications of the invention are intended to be covered by the foregoing description and the following claims.

We claim:

1. A thermal mechanical treatment method, comprising hot working a precipitation hardening martensitic stainless steel;

wherein the stainless steel comprises, in percent by weight:

11.0% to 12.5% chromium;
1.0% to 2.5% molybdenum;
0.15% to 0.5% titanium;
0.7% to 1.5% aluminum;
0.5% to 2.5% copper;
9.0% to 11.0% nickel;
up to 0.02% carbon;
up to 2.0% tungsten;
up to 0.001% boron;
iron; and
incidental impurities;

quenching the stainless steel; and aging the stainless steel, wherein the stainless steel is not solution heat treated prior to aging the stainless steel.

2. The method of claim 1, wherein the hot working comprises at least one of forging, piercing, rolling, and extruding.

3. The method of claim 1, wherein the hot working comprises a final hot working pass at a hot working temperature that is greater than the recovery temperature of the stainless steel.

4. The method of claim 1, wherein the hot working comprises a final hot working pass at a hot working temperature of 1500° F. to 2100° F.

5. The method of claim 1, wherein the hot working comprises a final hot working pass at a hot working temperature of 1600° F. to 2000° F.

6. The method of claim 1, wherein the hot working comprises a final hot working pass at a hot working temperature of 1700° F. to 1900° F.

7. The method of claim 1, wherein the hot working comprises a final hot working pass reduction of the precipitation hardening martensitic stainless steel alloy of 15% to 70%.

8. The method of claim 1, wherein the quenching comprises water quenching.

9. The method of claim 1, wherein the quenching comprises ice water quenching.

10. The method of claim 1, wherein the quenching comprises water quenching followed by ice water quenching.

11. The method of claim 1, wherein the aging comprises heating for an aging time and at an aging temperature sufficient to precipitate at least one hardening phase in the stainless steel.

12. The method of claim 11, wherein the aging temperature is about 950° F. and the aging time is about 4 hours.

13. The method of claim 11, wherein the aging temperature is about 1000° F. and the aging time is about 4 hours.

14. The method of claim 1, wherein the method does not comprise cryogenically cooling the stainless steel.

15. The method of claim 1, wherein the stainless steel consists essentially of, in percent by weight:

11.0% to 12.5% chromium;
1% to 2.5% molybdenum;
0.15% to 0.5% titanium;
0.7% to 1.5% aluminum;
0.5% to 2.5% copper;
9.0% to 11.0% nickel;
up to 0.02% carbon;
up to 2.0% tungsten;
up to 0.001% boron;
iron; and
incidental impurities.

16. An article, comprising:

a precipitation hardening martensitic stainless steel alloy having a process history comprising:
hot working the stainless steel alloy;
quenching the stainless steel alloy; and
aging the stainless steel alloy, wherein the stainless steel alloy is not solution heat treated prior to aging the stainless steel alloy;
wherein the stainless steel alloy comprises in percent by weight:
11.0% to 12.5% chromium;
1.0% to 2.5% molybdenum;
0.15% to 0.5% titanium;
0.7% to 1.5% aluminum;
0.5% to 2.5% copper;
9.0% to 11.0% nickel;
up to 0.02% carbon;
up to 2.0% tungsten;
up to 0.001% boron;
iron; and
incidental impurities.

17. The article of claim 16, wherein the precipitation hardening martensitic stainless steel consists essentially of, in percent by weight:

11.0% to 12.5% chromium;
1% to 2.5% molybdenum;
0.15% to 0.5% titanium;
0.7% to 1.5% aluminum;
0.5% to 2.5% copper;
9.0% to 11.0% nickel;
up to 0.02% carbon;
up to 2.0% tungsten;
up to 0.001% boron;
iron; and
incidental impurities.

18. The article of claim 16, wherein the article is an aerospace structural component.

19. The article of claim 18, wherein the aerospace structural component is selected from the group consisting of a flap track, an actuator, an engine mount, and a landing gear component.

20. The article of claim 16, wherein the hot working comprises at least one of forging, piercing, rolling, and extruding.

21. The article of claim 16, wherein the hot working comprises a final hot working pass at a hot working temperature that is greater than the recovery temperature of the stainless steel alloy.

22. The article of claim 16, wherein the hot working comprises a final hot working pass at a hot working temperature of 1500° F. to 2100° F.

23. The article of claim 16, wherein the hot working comprises a final hot working pass at a hot working temperature of 1600° F. to 2000° F.

24. The article of claim 16, wherein the hot working comprises a final hot working pass at a hot working temperature of 1700° F. to 1900° F.

25. The article of claim 16, wherein the hot working comprises a reduction of the precipitation hardening martensitic stainless steel alloy of 15% to 70%.

26. The article of claim 16, wherein the quenching comprises water quenching.

27. The article of claim 16, wherein the quenching comprises ice water quenching.

28. The article of claim 16, wherein the quenching comprises water quenching followed by ice water quenching.

29. The article of claim 16, wherein the aging comprises heating for an aging time and at an aging temperature sufficient to precipitate at least one hardening phase in the stainless steel.

30. The article of claim 29, wherein the aging temperature is about 950° F. and the aging time is about 4 hours.

31. The article of claim 29, wherein the aging temperature is about 1000° F. and the aging time is about 4 hours.

32. The article of claim 16, wherein the process history does not comprise cryogenically cooling the stainless steel.

* * * * *